United States Patent [19]

Kramer

[11] 4,401,215

[45] Aug. 30, 1983

[54] PROTECTIVE BRUSH HOLDER

[76] Inventor: Remi T. Kramer, Rte. #2, Box 262B, Sandpoint, Id. 83864

[21] Appl. No.: 337,029

[22] Filed: Jan. 4, 1982

[51] Int. Cl.[3] ..... A65D 44/18

[52] U.S. Cl. ..... 206/362.3

[58] Field of Search ..... 206/361, 362, 362.1, 206/362.2, 362.3, 306, 379; 224/904

[56] References Cited

U.S. PATENT DOCUMENTS

| | | | |
|---|---|---|---|
| 601,725 | 4/1898 | Chatelaine | 224/904 |
| 741,321 | 10/1903 | Flower | 206/362.3 |
| 1,651,496 | 12/1927 | Weinberg | 206/362.3 |
| 2,655,968 | 10/1953 | Simmons | 206/362.3 |
| 2,947,412 | 8/1960 | Tupper | 206/362.3 |
| 3,746,162 | 7/1973 | Bridges | 206/361 |
| 4,061,226 | 12/1977 | Essen | 206/306 |
| 4,190,955 | 3/1980 | Rushforth | 224/904 |
| 4,198,171 | 4/1980 | Lampka et al. | 206/362.2 |

*Primary Examiner*—George E. Lowrance
*Assistant Examiner*—Jimmy G. Foster
*Attorney, Agent, or Firm*—Beehler, Pavitt, Siegemund, Jagger & Martella

[57] ABSTRACT

A protective holder for long-handled brushes of the type used for brushing teeth makes use of a purse-like container of relatively yieldable plastic material with a slit at one end adapted to be forced open when the head of the brush is inserted and then to close after insertion. A recess of progressively variable breadth accommodates the holder to brushes of different breadths, so that the brush is retained in the holder whether the holder lays flat on a supporting surface or stood upright on one end.

1 Claim, 6 Drawing Figures

Fig. 1.
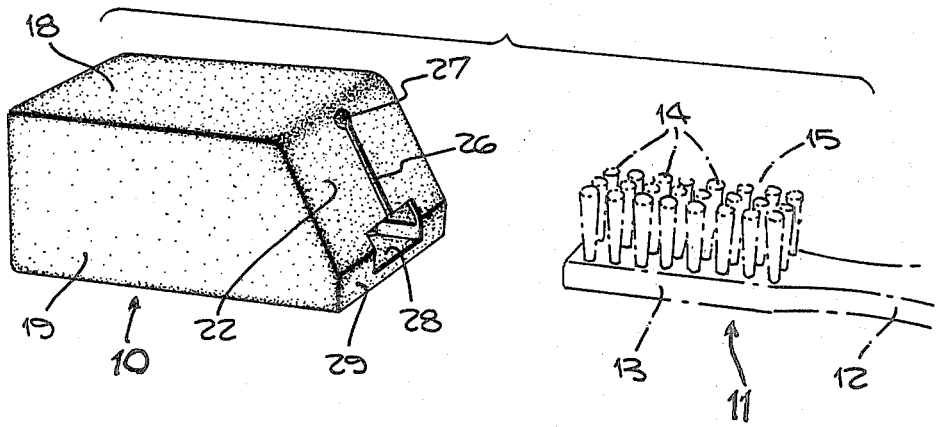
Fig. 2.
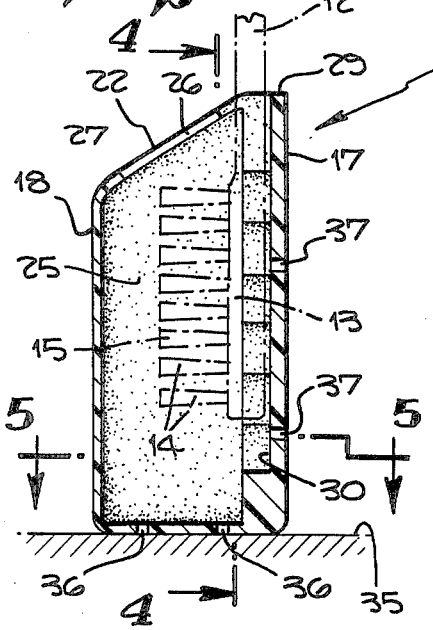
Fig. 3.
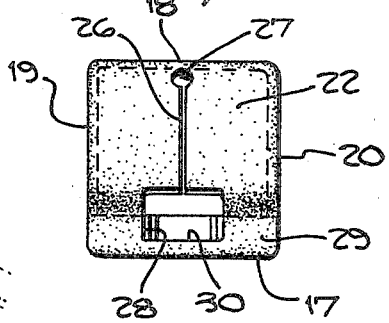
Fig. 6.
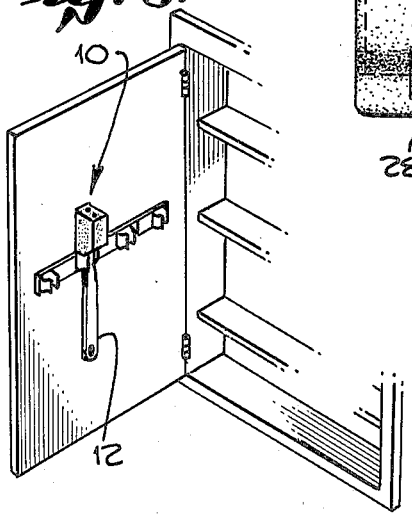
Fig. 4.
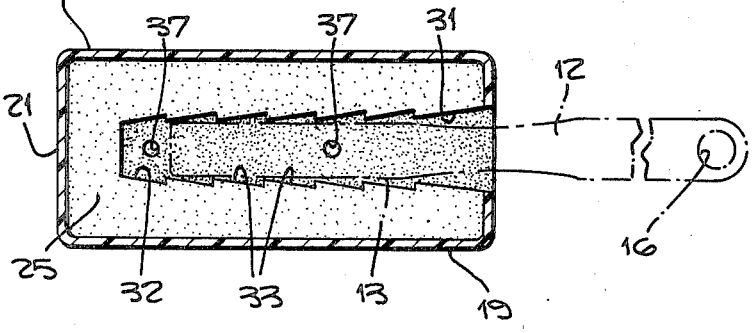
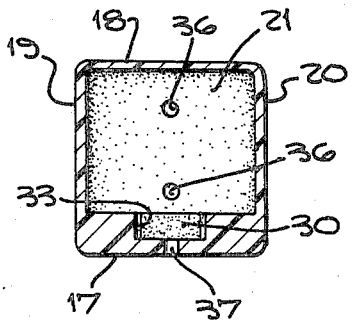
Fig. 5.

PROTECTIVE BRUSH HOLDER

For almost as long as long-handled toothbrushes have been available, numerous and repeated attempts have been made to provide some kind of box or container for the toothbrush, especially when it needs to be carried about as when traveling. The most common expedient has been that of a plastic box slightly longer than the full length of the brush and its handle provided with a removable cap. Most of these long boxes are dimensioned to as to accommodate a single long-handled toothbrush, although some are large enough for two or more such brushes. Flexible bags for one or more long-handled brushes have also been tried in the interest of low cost and availability. Such containers have rarely been adequately ventilated and as a consequence, when the brush is stored in such a case when wet and left for some appreciable length of time, especially under circumstances where the bristles are not entirely clean, the storage becomes somewhat unsanitary.

More sophisticated holders for one or more toothbrushes have also been made available, but the common objection to virtually all of these is cost, and frequently size, especially when being used for travel. In the case of the more expensive type of toothbrush holder, the cover is usually fastened in place and is always available. In the case of the very inexpensive plastic box with its separate lid, the lid frequently comes off when the box is being carried about, the lid being light and small, commonly gets misplaced and often lost.

It is therefore among the objects of the invention to provide a new and improved portable brush holder for long-handled toothbrush type brushes which is inexpensive, made of a single piece, and of such construction that the head end or brush part of the toothbrush can be pushed into the holder.

Another object of the invention is to provide a new and improved portable brush holder for long-handled brushes such as toothbrushes which is of a character such that it fits brushes of virtually any size.

Still another object of the invention is to provide a new and improved brush holder for long-handled toothbrushes which, though made of but a single piece forming a container, is nevertheless ventilated while the brush is in place and moreover of such character that it can be readily cleaned and drained when necessary.

Still another object of the invention is to provide a new and improved holder for long-handled brushes which consists of a container accommodating only the brush end of the assembly in an arrangement such that the container with its contents can either be laid on the counter, stood on end, or suspended by the handle of the brush, in all positions of which the container remains ventilated and capable of draining off moisture.

Still further among the objects of the invention is to provide a new and improved brush holder for long-handle toothbrushes which, being molded of but a single piece, is especially inexpensive, easily adapted to the retention of a single brush, provided with no more than a flexible slit so that the brush can be slid into and out of the container at will, and in which there is provided means for holding the brush in the container once in place irrespective of the size of the brush.

With these and other objects in view, the invention consists of the construction, arrangement, and combination of the various parts of the device serving as an example only of one or more embodiments of the invention, whereby the objects contemplated are attained, as hereinafter disclosed in the specification and pointed out in the appended claims.

FIG. 1 is a side perspective view of the brush holder in position ready for reception of the brush end of a long-handled toothbrush assembly.

FIG. 2 is a longitudinal sectional view on the line 2—2 of FIG. 1 but in which the holder is placed in an upstanding position.

FIG. 3 is a left end elevational view.

FIG. 4 is a longitudinal sectional view taken on the line 4—4 of FIG. 2.

FIG. 5 is a cross-sectional view taken on the line 5—5 of FIG. 2.

FIG. 6 is a perspective view of a conventional cabinet equipped with a brush rack on which the invention may be hung.

In an embodiment of the invention chosen for the purpose of illustration the brush holder is shown in the form of a container 10 adapted to accommodate a brush assembly 11 which consists of a long handle 12 having a head portion 13 provided with groups of bristles 14 forming a brush 15. The long handle may on occasions be provided with a hole 16 so that the brush assembly can be hung up.

The container more particularly consists of a base wall 17 opposite which is a face wall 18. Side walls 19 and 20 extend between the base wall and face wall, there being respectively a bottom end wall 21 and a top end wall 22 which, together with the other walls, form a closed chamber 25.

In the top end wall 22 is a slit 26 extending from a hole 27 to a substantially rectangular opening 28. It is of interest to note that the top end wall 22 is obliquely disposed except for a relatively flat ledge 29 which contains a portion of the rectangular opening 28.

It is further of consequence that the container 10, or at least the top end wall portion 22, be of relatively flexible synthetic plastic resin material so that the container can, in effect, be opened like a purse when the brush 15 and head 13 of the brush assembly is pushed into place within the chamber.

It is further of material consequence that there be provided in one of the walls of the container, preferably the base wall 17, an elongated recess 30. Attention is further directed to the fact that the right-hand end 31 of the recess 30, as viewed in FIG. 4, is wider than the left-hand end 32. Between the left-hand end and the right-hand end there may be provided a series of stepped configurations 33 which, as viewed in FIG. 4, resemble teeth. The container material being of yieldable flexible character, as are also the configurations 33, result in there being provided a recess of variable width to accommodate brush assemblies wherein the head 13 may vary appreciably in width. With a construction of the type made reference to, any one of a number of different sizes of toothbrush can be snugly accommodated by the recess and releasably held in position within the chamber 25 ready for withdrawal at the convenience of the operator. As a consequence, two separate expedients are present for holding the brush in the container. One is the recess 30 of variable width. The other is the container itself wherein the yieldable sides of the slit 26 prevent the container from inadvertently falling loose from the head of the brush assembly as it might be pulled against the bristles 13.

Furthermore, constructed as shown, the container 10 may have the bottom end wall 21 supported upon a supporting surface 35 so that the container and the brush assembly stand in upright position as shown in FIG. 2. In the alternative the base wall 17 may rest upon the supporting surface so that the container and the brush occupy a horizontal position as shown in FIG. 1. As a still further alternative, in the event that the long handle 12 is provided with a hole 16, the brush assembly can be hung upon a suitable hook with the container 10 retained in place.

Further still, there are provided in the bottom end wall 21 drain holes 36. Similar drain holes 37 are provided in the base wall 17. These drain holes are capable, depending upon the position of rest of the container 10, either to drain off excessive water or to aid in ventilation of the chamber 25, aided by the hole 27 and the rectangular opening 28.

As shown in FIG. 6, the container 10 with the brush assembly 11 inserted can be hung on a conventional toothbrush rack with the handle 12 hanging downwardly to balance it.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A protective holder for a brush assembly with an elongated handle wherein at a head end of the brush assembly an array of bristles extends transversely to form a brush, said holder comprising a container having a base wall, end walls adjacent opposite ends, side walls intermediate the end walls and a face wall, said walls forming a chamber for reception of the brush, one of said end walls being relatively yieldable and having a slit therein with sides of the slit being of yieldable character and adapted to spread temporarily for admission of the brush into the chamber, there being an elongated recess on the inside face of one of said walls of breadth narrowing progressively from a location adjacent said slit to a location adjacent the end wall at the end of the container opposite said slit for releasable retention of the brush assembly there being stepped configurations on inside faces of said recess for releasable retention of brush assemblies of different breadths.

* * * * *